US007868195B2

(12) United States Patent
Fleischer et al.

(10) Patent No.: US 7,868,195 B2
(45) Date of Patent: Jan. 11, 2011

(54) SYSTEMS AND METHODS FOR EXTRACTING LIPIDS FROM AND DEHYDRATING WET ALGAL BIOMASS

(76) Inventors: Daniel Fleischer, 1301 Harbor Bay Pkwy., Alameda, CA (US) 94502; Marko Jukic, 1301 Harbor Bay Pkwy., Alameda, CA (US) 94502; Andrew Thompson, 1301 Harbor Bay Pkwy., Alameda, CA (US) 94502; Guido Radaelli, 1301 Harbor Bay Pkwy., Alameda, CA (US) 94502

( * ) Notice: Subject to any disclaimer, the term of this patent is extended or adjusted under 35 U.S.C. 154(b) by 0 days.

(21) Appl. No.: 12/610,134

(22) Filed: Oct. 30, 2009

(65) Prior Publication Data

US 2010/0261922 A1 Oct. 14, 2010

(51) Int. Cl.
*C11B 1/00* (2006.01)

(52) U.S. Cl. ..... 554/20

(58) Field of Classification Search ..... 554/20
See application file for complete search history.

(56) References Cited

U.S. PATENT DOCUMENTS 5,539,133 A * 7/1996 Kohn et al. ..... 554/20

* cited by examiner

*Primary Examiner*—Deborah D Carr
(74) *Attorney, Agent, or Firm*—Carr & Ferrell LLP

(57) ABSTRACT

Exemplary methods include centrifuging a wet algal biomass to increase a solid content of the wet algal biomass to between approximately 10% and 40% to result in a centrifuged algal biomass, mixing the centrifuged algal biomass with an amphiphilic solvent to result in a mixture, heating the mixture to result in a dehydrated, defatted algal biomass, separating the amphiphilic solvent from the dehydrated, defatted algal biomass to result in amphiphilic solvent, water and lipids, evaporating the amphiphilic solvent from the water and the lipids, and separating the water from the lipids. The amphiphilic solvent may be selected from a group consisting of acetone, methanol, ethanol, isopropanol, butanone, dimethyl ether, and propionaldehyde. Other exemplary methods include filtering a wet algal biomass through a membrane to increase a solid content of the wet algal biomass to between approximately 10% and 40% to result in a filtered algal biomass.

20 Claims, 2 Drawing Sheets

SYSTEMS AND METHODS FOR EXTRACTING LIPIDS FROM AND DEHYDRATING WET ALGAL BIOMASS

BACKGROUND OF THE INVENTION

1. Field of the Invention

Embodiments of the present invention relate to extracting lipids from and dehydrating wet algal biomass.

2. Description of Related Art

Microalgae differentiate themselves from other single-cell microorganisms in their natural ability to accumulate large amounts of lipids. Because most lipidic compounds have the potential to generate biofuels and renewable energy, there is a need for systems and methods for extracting lipids from and dehydrating wet algal biomass.

SUMMARY OF THE INVENTION

Exemplary methods include centrifuging a wet algal biomass to increase a solid content of the wet algal biomass to between approximately 10% and 40% to result in a centrifuged algal biomass, mixing the centrifuged algal biomass with an amphiphilic solvent to result in a mixture, heating the mixture to result in a dehydrated, defatted algal biomass, separating the amphiphilic solvent from the dehydrated, defatted algal biomass to result in amphiphilic solvent, water and lipids, evaporating the amphiphilic solvent from the water and the lipids, and separating the water from the lipids. The amphiphilic solvent may be selected from a group consisting of acetone, methanol, ethanol, isopropanol, butanone, dimethyl ether, and propionaldehyde. According to a further embodiment, the mixture may be heated in a pressurized reactor, which may be a batch or a continuous pressurized reactor. The mixture may be heated with microwaves, ultrasound, steam, or hot oil. The amphiphilic solvent may be separated from the dehydrated, defatted algal biomass via membrane filtration to result in amphiphilic solvent, water and lipids.

Other exemplary methods include filtering a wet algal biomass through a membrane to increase a solid content of the wet algal biomass to between approximately 10% and 40% to result in a filtered algal biomass, mixing the filtered algal biomass with an amphiphilic solvent to result in a mixture, heating the mixture to result in a dehydrated, defatted algal biomass, separating the amphiphilic solvent from the dehydrated, defatted algal biomass to result in amphiphilic solvent, water and lipids, evaporating the amphiphilic solvent from the water and the lipids, and separating the water from the lipids. According to a further exemplary embodiment, the wet algal biomass may be filtered to increase the solid content to approximately 30%.

DETAILED DESCRIPTION

According to various exemplary systems and methods, wet microalgal biomass is simultaneously defatted and dehydrated by extraction with an amphiphilic solvent. The microalgal biomass (70% to 90% water) is contacted with an amphiphilic solvent such as liquid dimethyl ether or acetone and heated (50 degrees C. to 150 degrees C.) with vigorous mixing under pressure (5 bar to 30 bar). The solids (carbohydrates and proteins) are separated from the liquid (solvent, water and dissolved lipids) by membrane filtration, decantation or centrifugation. The liquid portion is then distilled to recover the solvent, leaving behind crude lipids and water, which are separated by their density difference. The crude lipids may be transesterified into biodiesel. The solid portion is heated to recover traces of solvent, resulting in a dry, defatted biomass product.

Figure 1:
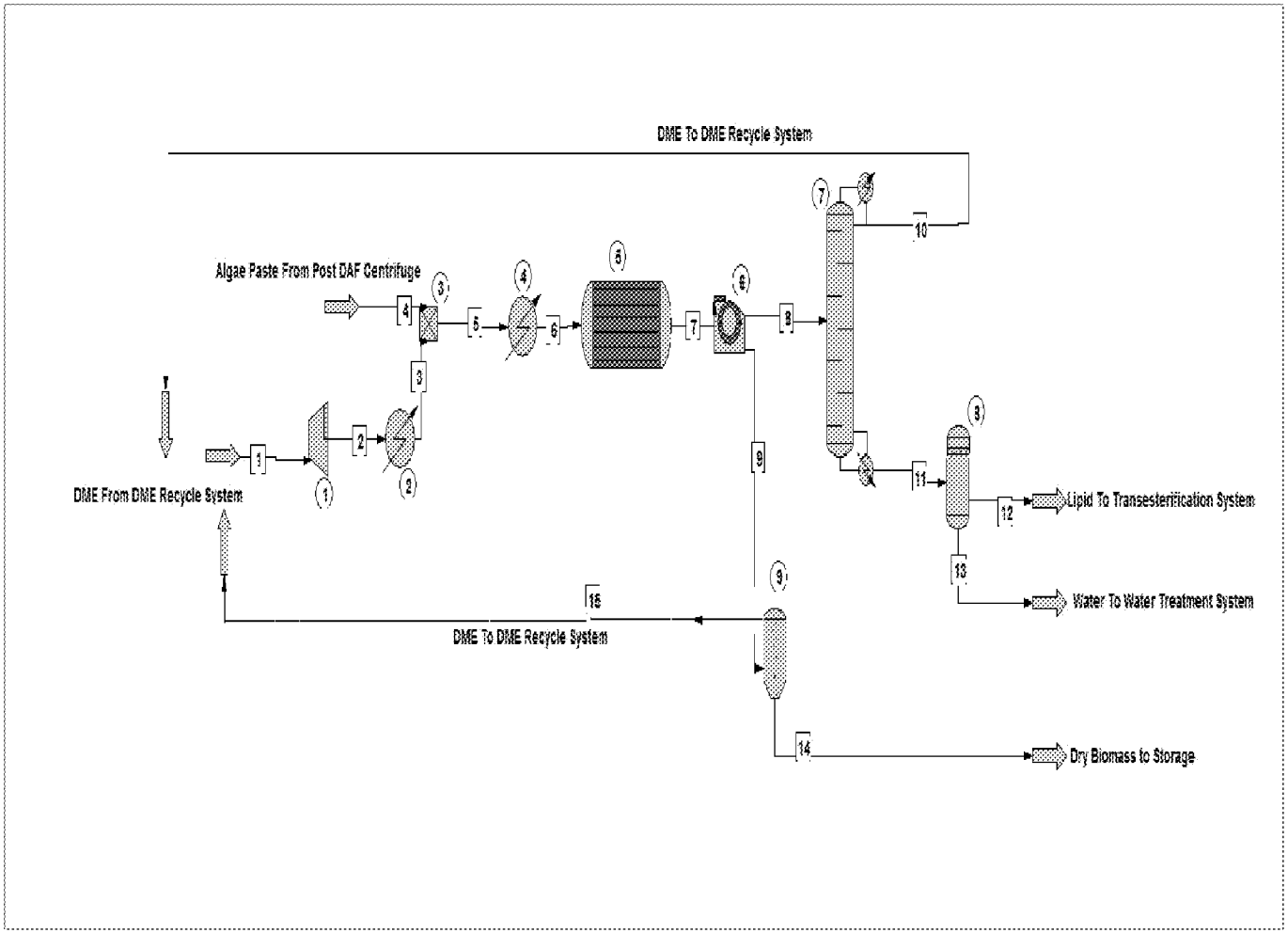
FIG. 1 shows a system for extracting lipids from and dehydrating wet algal biomass according to one exemplary embodiment.

FIG. 1 shows a system for extracting lipids from and dehydrating wet algal biomass, according to one exemplary embodiment. The exemplary system comprises a compressor (1), a first heat exchanger (2), a mixer (3), a second heat exchanger (4), a reactor system (5), a solids remover (6), a distillation unit (7), a phase separation station (8), and a solvent recovery unit (9). According to various exemplary embodiments, the compressor (1) compresses the dimethyl ether to a liquid. The first heat exchanger (2) cools the compressed dimethyl ether (in liquid form). The mixer (3) mixes the dimethyl ether and algae paste. The second heat exchanger (4) adjusts the temperature of the dimethyl ether and algae paste mixture. The reactor system (5) extracts the lipids and dewaters the algae cells. The solids remover (6) separates the defatted and dewatered biomass from the liquid. The distillation unit (7) removes the dimethyl ether. The phase separation station (8) separates the oil from the water. The solvent recovery unit (9) removes residual dimethyl ether from the biomass.

In another exemplary embodiment, the mixer (3) mixes a biomass with the dimethyl ether. Solvents other than dimethyl ether may be used. Desirable alternative solvents should allow for the effective dissolving of both lipids and water, and should be efficiently distilled from the water. Such alternative amphiphilic solvents may include without limitation, acetone, methanol, ethanol, isopropanol, butanone, propionaldehyde, and other similar solvents. The mixture is pumped through the reactor system (5) at a suitable temperature, pressure and residence time. The reactor system (5) receives pressure from compressor (1) and heat from the second heat exchanger (4). The reactor may be batch, continuous, counter-current, co-current, cascading multistage or another type of heated, pressurized liquid mixing system. The heat exchanger (4) may include, but is not limited to microwaves, ultrasound, convection, steam, hot vapor, induction, electrical resistive heating element, etc. Alternatively, the biomass may be mixed with the dimethyl ether in a continuous, heated and pressurized counter-current liquid-liquid extractor.

The mixture is then passed through the solids remover (6), which may comprise a membrane filtration system or centrifuge. The solids are collected and sent to a solvent recovery unit (9). The filtrate or supernatant is transferred to the distillation unit (7), for flash evaporation or distillation that recovers the dimethyl ether. The remaining water and lipid mixture may be separated at the phase separation station (8), which may comprise an oil separator. Alternatively, the remaining water and lipid mixture may be sent to a liquid-liquid extractor to extract the lipids with hexane which may be sent to an evaporator to yield the lipids.

Figure 2:
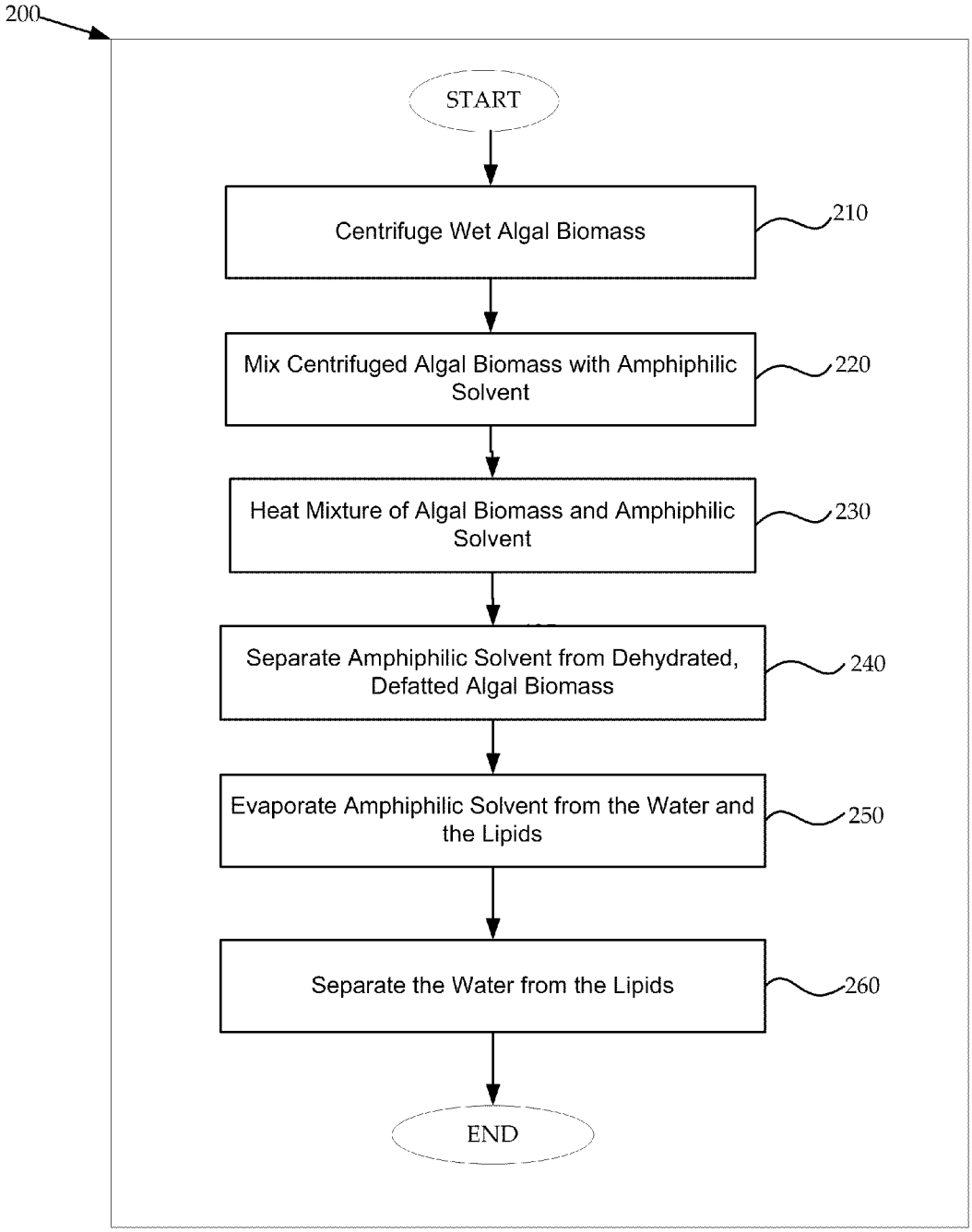
FIG. 2 is a diagram showing an exemplary method for extracting lipids from and dehydrating wet algal biomass.

FIG. 2 is a diagram showing an exemplary method 200 for extracting lipids from and dehydrating wet algal biomass.

At step 210, wet algal biomass is centrifuged to increase its solid content to a range of approximately ten percent (10%) to forty percent (40%). According to another exemplary embodiment, membrane filtration is used instead of centrifugation.

At step 220, the centrifuged algal biomass is mixed with an amphiphilic solvent to result in a mixture. According to one exemplary embodiment, solvents other than dimethyl ether may be used. Desirable alternative solvents should allow for the effective dissolving of both lipids and water, and should be efficiently distilled from the water. Such alternative amphiphilic solvents may include without limitation, acetone, methanol, ethanol, isopropanol, butanone, propionaldehyde, and other similar solvents.

At step 230, the mixture is heated to result in a dehydrated, defatted algal biomass. In various exemplary embodiments, the mixture is pumped through the reactor system (5) (FIG. 1) at a suitable temperature, pressure and residence time. The reactor system (5) receives pressure from compressor (1) (FIG. 1) and heat from the second heat exchanger (4) (FIG. 1). The reactor may be batch, continuous, counter-current, co-current, cascading multistage or another type of heated, pressurized liquid mixing system. The heat exchanger (4) may include, but is not limited to microwaves, ultrasound, convection, steam, hot vapor, induction, electrical resistive heating element, etc. Alternatively, the biomass may be mixed with the dimethyl ether in a continuous, heated and pressurized counter-current liquid-liquid extractor.

At step 240, the amphiphilic solvent is separated from the dehydrated, defatted algal biomass to result in amphiphilic solvent, water, and lipids. According to one exemplary embodiment, the mixture is passed through the solids remover (6) (FIG. 1), which may comprise a membrane filtration system or centrifuge. The solids are collected and sent to a solvent recovery unit (9).

At step 250, the amphiphilic solvent is evaporated from the water and the lipids. In various exemplary embodiments, the filtrate or supernatant is transferred to the distillation unit (7) (FIG. 1), for flash evaporation or distillation that recovers the dimethyl ether.

At step 260, the water is separated from the lipids. According to various exemplary embodiments, the remaining water and lipid mixture may be separated at the phase separation station (8) (FIG. 1), which may comprise an oil separator. Alternatively, the remaining water and lipid mixture may be sent to a liquid-liquid extractor to extract the lipids with hexane which may be sent to an evaporator to yield the lipids.

EXAMPLE ONE 250 grams of microalgal biomass paste of 80% water content is mixed with 250 g of dimethyl ether in a sealed 2 liter pressure vessel. The vessel is pressurized to 135 psi with nitrogen. The vessel is then heated with vigorous stirring for 30 minutes at 80 degrees C. The contents of the vessel are then siphoned into a pressurized membrane filtration system with the filtrate passing into an evaporator. The retentate is put back in the pressure vessel and mixed with an additional 250 g of dimethyl ether, and the vessel again stirred under 100 psi nitrogen at 80 degrees C. for 30 minutes. After membrane filtration, the second filtrate is sent to the evaporator, and the dimethyl ether distilled at atmospheric pressure and recovered by condensation. What remains is water with a layer of lipids floating on top. These can be extracted twice with 20 mls of hexane, which is then evaporated under a stream of nitrogen to yield the lipids. The retentate can be easily dried of dimethyl ether under a gentle stream of nitrogen to yield the defatted, dehydrated biomass.

EXAMPLE TWO 1 gram of microalgal biomass paste of 80% water content is mixed with 1 ml of acetone and sealed in a 15 ml test tube. The tube is then heated for 20 minutes at 80 degrees C. The tube is then centrifuged for 5 minutes at 2300 RCF and the supernatant decanted into another tube. To the pellet is added an additional 1 ml of acetone, and the tube sealed and heated at 80 degrees C. for another 20 minutes. After centrifugation, the combined supernatants are evaporated under a stream of nitrogen at 37 degrees C. What remains is water with a layer of lipids floating on top. These can be extracted twice with 2 mls of hexane, which is then evaporated under a stream of nitrogen to yield the lipids. The pellet can be easily dried of acetone under a gentle stream of nitrogen to yield the defatted, dehydrated biomass.

While various embodiments have been described herein, it should be understood that they have been presented by way of example only, and not limitation. Thus, the breadth and scope of a preferred embodiment should not be limited by any of the herein-described exemplary embodiments.

The invention claimed is:

1. A method comprising:

centrifuging a wet algal biomass to increase a solid content of the wet algal biomass to between approximately 10% and 40% to result in a centrifuged algal biomass;

mixing the centrifuged algal biomass with an amphiphilic solvent to result in a mixture;

heating the mixture to result in a dehydrated, defatted algal biomass;

separating the amphiphilic solvent from the dehydrated, defatted algal biomass to result in amphiphilic solvent, water and lipids;

evaporating the amphiphilic solvent from the water and the lipids; and separating the water from the lipids.

2. The method of claim 1, wherein the amphiphilic solvent is selected from the group consisting of acetone, methanol, ethanol, isopropanol, butanone, dimethyl ether, and propionaldehyde.

3. The method of claim 1, wherein the mixture is heated in a pressurized reactor.

4. The method of claim 3, wherein the pressurized reactor is a batch or a continuous pressurized reactor.

5. The method of claim 1, wherein the mixture is heated with microwaves, ultrasound, steam, or hot oil.

6. The method of claim 1, wherein the amphiphilic solvent is separated from the dehydrated, defatted algal biomass via membrane filtration to result in amphiphilic solvent, water and lipids.

7. The method of claim 1, wherein the amphiphilic solvent is separated from the dehydrated, defatted algal biomass via centrifugation to result in amphiphilic solvent, water and lipids.

8. The method of claim 1, wherein the separating includes decanting the amphiphilic solvent from the dehydrated, defatted algal biomass to result in amphiphilic solvent, water and lipids.

9. The method of claim 1, wherein the separating of the water from the lipids includes adding a nonpolar solvent.

10. The method of claim 9, wherein the nonpolar solvent is propane, butane, pentane, hexane, butene, propene, naphtha or gasoline.

11. A method comprising:

filtering a wet algal biomass through a membrane to increase a solid content of the wet algal biomass to between approximately 10% and 40% to result in a filtered algal biomass;

mixing the filtered algal biomass with an amphiphilic solvent to result in a mixture;

heating the mixture to result in a dehydrated, defatted algal biomass;

separating the amphiphilic solvent from the dehydrated, defatted algal biomass to result in amphiphilic solvent, water and lipids;

evaporating the amphiphilic solvent from the water and the lipids; and separating the water from the lipids.

12. The method of claim 11, wherein the wet algal biomass is filtered to increase the solid content to approximately 30%.

13. The method of claim 11, wherein the amphiphilic solvent is selected from the group consisting of acetone, methanol, ethanol, isopropanol, butanone, dimethyl ether, and propionaldehyde.

14. The method of claim 11, wherein the mixture is heated in a pressurized reactor.

15. The method of claim 14, wherein the pressurized reactor is a batch or a continuous pressurized reactor.

16. The method of claim 11, wherein the mixture is heated with microwaves, ultrasound, steam, or hot oil.

17. The method of claim 11, wherein the amphiphilic solvent is separated from the dehydrated, defatted algal biomass via membrane filtration to result in amphiphilic solvent, water and lipids.

18. The method of claim 11, wherein the amphiphilic solvent is separated from the dehydrated, defatted algal biomass via centrifugation to result in amphiphilic solvent, water and lipids.

19. The method of claim 11, wherein the separating includes decanting the amphiphilic solvent from the dehydrated, defatted algal biomass to result in amphiphilic solvent, water and lipids.

20. The method of claim 11, wherein the separating of the water from the lipids includes adding a nonpolar solvent.

* * * * *